US007506568B2

(12) United States Patent
King

(10) Patent No.: US 7,506,568 B2
(45) Date of Patent: Mar. 24, 2009

(54) SEALED UPSCALE TOTAL CONTAINMENT VESSEL

(75) Inventor: Kim W. King, San Antonio, TX (US)

(73) Assignee: NABCO, Inc., Canonsburg, PA (US)

( * ) Notice: Subject to any disclaimer, the term of this patent is extended or adjusted under 35 U.S.C. 154(b) by 265 days.

(21) Appl. No.: 10/982,182

(22) Filed: Nov. 5, 2004

(65) Prior Publication Data

US 2009/0044690 A1 Feb. 19, 2009

Related U.S. Application Data

(60) Provisional application No. 60/517,632, filed on Nov. 5, 2003.

(51) Int. Cl.
*F42B 33/00* (2006.01)

(52) U.S. Cl. ..... 86/50; 588/403; 588/900

(58) Field of Classification Search ..... 86/50; 588/403, 249, 259, 261, 900; 422/165, 163; 206/521, 591; 220/62.11; 110/237, 346
See application file for complete search history.

(56) References Cited

U.S. PATENT DOCUMENTS

| | | | | |
|---|---|---|---|---|
| 1,426,920 | A | 8/1922 | Sleeper | |
| 1,520,784 | A * | 12/1924 | Taylor | 220/323 |
| 2,605,724 | A * | 8/1952 | Baier | 110/173 R |
| 2,780,350 | A | 2/1957 | Simon | |
| 2,936,592 | A | 5/1960 | Suderow | |
| 2,940,300 | A | 6/1960 | Loving | |
| 3,145,837 | A | 8/1964 | Lewis | |
| 3,481,504 | A | 12/1969 | Nelson | |
| 3,739,731 | A | 6/1973 | Tabor | |
| 3,820,435 | A | 6/1974 | Rogers | |
| 4,055,247 | A | 10/1977 | Benedick | |
| 4,110,173 | A | 8/1978 | Dix | |
| 4,389,947 | A | 6/1983 | King | |
| 4,474,052 | A | 10/1984 | Bodurtha, Jr. | |
| 4,478,350 | A * | 10/1984 | Ohlsson | 220/560.01 |
| 4,589,341 | A | 5/1986 | Clark | |
| 4,594,513 | A | 6/1986 | Suzuki | |
| 4,628,819 | A | 12/1986 | Backofen, Jr. | |
| 4,876,124 | A | 10/1989 | Dallum | |
| 4,889,258 | A | 12/1989 | Yerushalmi | |
| 5,251,473 | A | 10/1993 | Reese | |
| 5,271,493 | A | 12/1993 | Hall | |
| 5,419,862 | A * | 5/1995 | Hampel | 264/84 |
| 5,601,204 | A | 2/1997 | Hall | |
| 5,684,264 | A | 11/1997 | Cassells | |
| 5,884,569 | A | 3/1999 | Donovan | |
| 5,904,265 | A | 5/1999 | Zandbergen | |
| 6,042,139 | A | 3/2000 | Knox | |
| RE36,912 | E | 10/2000 | Donovan | |
| 6,173,662 | B1 | 1/2001 | Donovan | |

(Continued)

*Primary Examiner*—James S Bergin
(74) *Attorney, Agent, or Firm*—The Webb Law Firm

(57) ABSTRACT

Disclosed is a blast containment vessel. A body has an opening. An external door is configured to form a seal surrounding the opening when the external door is in a closed position. A yoke is configured to retain the door in the closed position. A first automatic system is configured to automatically move the external door into and out of the closed position. A second automatic system is configured to automatically move the yoke when the external door is in the closed position. During and after a blast event, the body and the external door contain products of the blast event and the seal remains intact.

14 Claims, 6 Drawing Sheets

U.S. PATENT DOCUMENTS 6,196,107 B1 3/2001 Hoffman
6,644,165 B1 11/2003 King
6,881,383 B1 * 4/2005 Tschritter et al. ..... 422/165
2005/0029262 A1 * 2/2005 Bosik et al. ..... 220/88.1

* cited by examiner

SEALED UPSCALE TOTAL CONTAINMENT VESSEL

CROSS-REFERENCE TO RELATED APPLICATIONS

This application claims the benefit of U.S. Provisional Patent Application Ser. No. 60/517,632, filed Nov. 5, 2003.

BACKGROUND OF THE INVENTION

1. Field of the Invention

The present invention is directed to a blast containment vessel, and more particularly, to a containment vessel that can be used for the safe containment, transportation, and disposal of an explosive device having a biological or chemical agent associated with it.

2. Description of Related Art

Increased terrorist incidents have heightened awareness of the vulnerability to potential terrorist activity and the terrorist's willingness to strike targets in the United States. One particular concern that has extremely harmful results is the potential of an improvised explosive device (IED) that has a biological or chemical agent associated with it. Thus, a need exists for blast containment vessels that can be used for the safe containment, transportation, and disposal of these devices.

Currently, NABCO, Inc. provides a total containment vessel (TCV) and an upscale total containment vessel (UTCV). The TCV is capable of being a sealed or gas-tight vessel. The TCV has an external door, in addition to an internal blast door, which bolts in place by hand through 16 bolts. There are various ports that facilitate sampling the interior atmosphere of the vessel, decontaminating the interior of the vessel, and initiating a counter charge to detonate the IED.

In a sealed blast containment vessel, a challenging aspect is the complete containment of the high pressure atmosphere during a detonation without any (or extremely low levels of) leakage. The most critical location for mitigating leakage is around the door (the largest opening in the vessel).

BRIEF SUMMARY OF THE INVENTION

It is an object of this invention to provide a sealed upscale total containment vessel (UTCV).

The present invention is a sealed UTCV including a vessel body and a hinged external door retained by a split yoke.

Inflatable seals of a conventional UTCV are replaced with large o-rings. Preferably, three o-rings are used to maintain redundancy in the system. A first o-ring is located in a valley in a opening support ring. The primary purpose of the first o-ring is to suppress flames and hot gasses generated during the detonation and to protect a second and third o-ring. The second and third o-rings are located in a door support ring and provide a redundant sealing mechanism. The door support ring also has a ridge that protrudes from a surface of the door support ring and mates with the valley in the opening support ring. This ridge and mating valley also serve to mitigate the flames and hot gasses, as well as protect the second and third o-rings from the blast load.

The door is supported on a hinge that is mounted to a support frame. A hydraulically operated system automatically closes the external door. The door is moved from an open to a closed position by a hydraulic cylinder that is mounted to the support frame. In the absence of hydraulic power, the door can be closed by hand. Two halves of the yoke are moved into the closed position by two threaded rods powered by a hydraulic motor. The motor turns the lower threaded rod. The upper threaded rod is turned simultaneously by a chain drive system. Alternatively, the two threaded rods can be closed by hand in the absence of power to the hydraulic system by a hand wheel located on the top threaded rod.

The present invention eliminates the 16 bolt closing system on the prior art TCV. The present invention has a simplified sealing system and eliminates inflatable seals. The present invention allows for a fully automated door and closing mechanism. The present invention allows for a reduced size in a vessel reinforcing ring and an enlarged opening. The present invention eliminates the internal door of the prior art TCV.

DETAILED DESCRIPTION OF THE INVENTION

Figure 1:
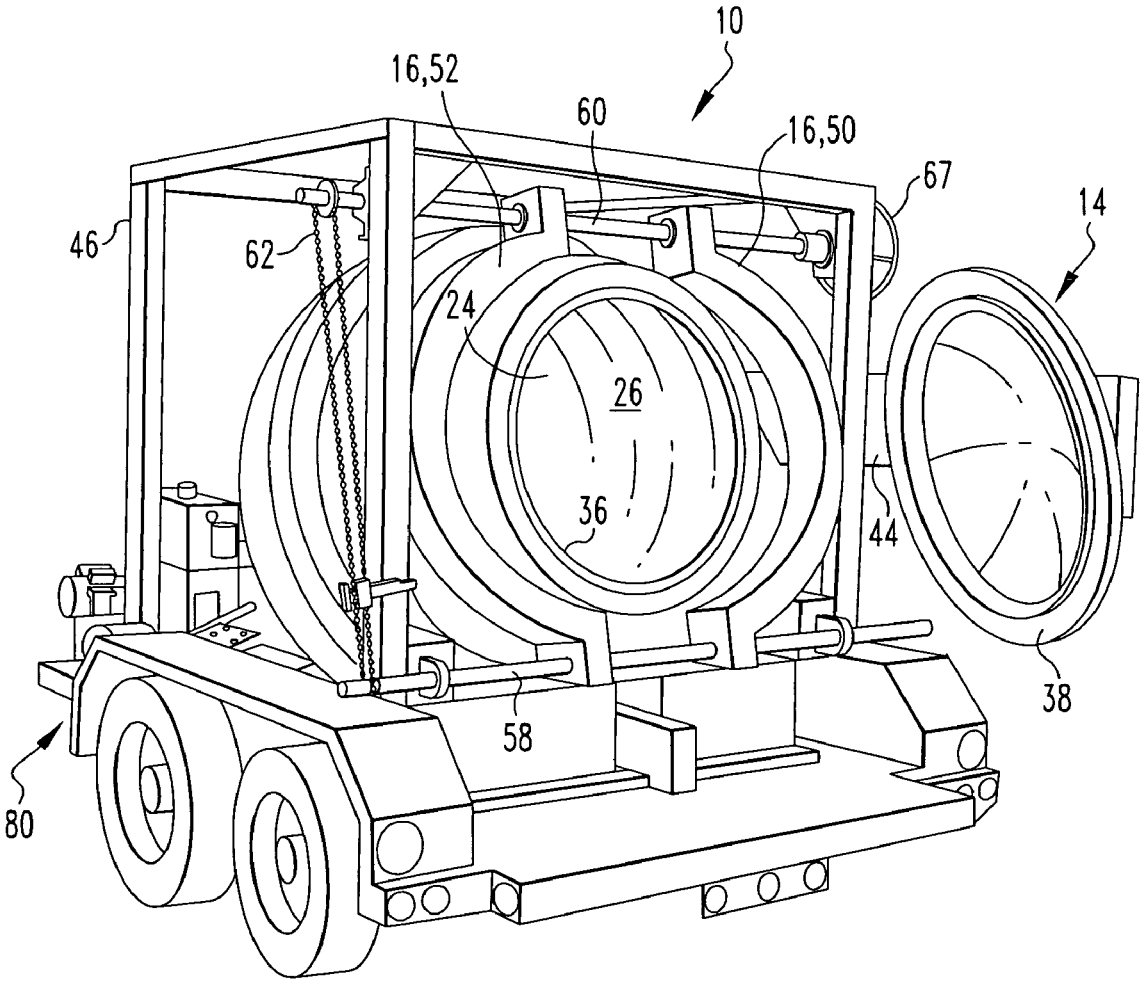
FIG. 1 is an illustration of the present invention.

A complete understanding of the invention will be obtained from the following description when taken in connection with the accompanying drawing figures wherein like reference characters identify like parts throughout.

For purposes of the description hereinafter, the terms "upper", "lower", "right", "left", "vertical", "horizontal", "top", "bottom", and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

Figure 2:
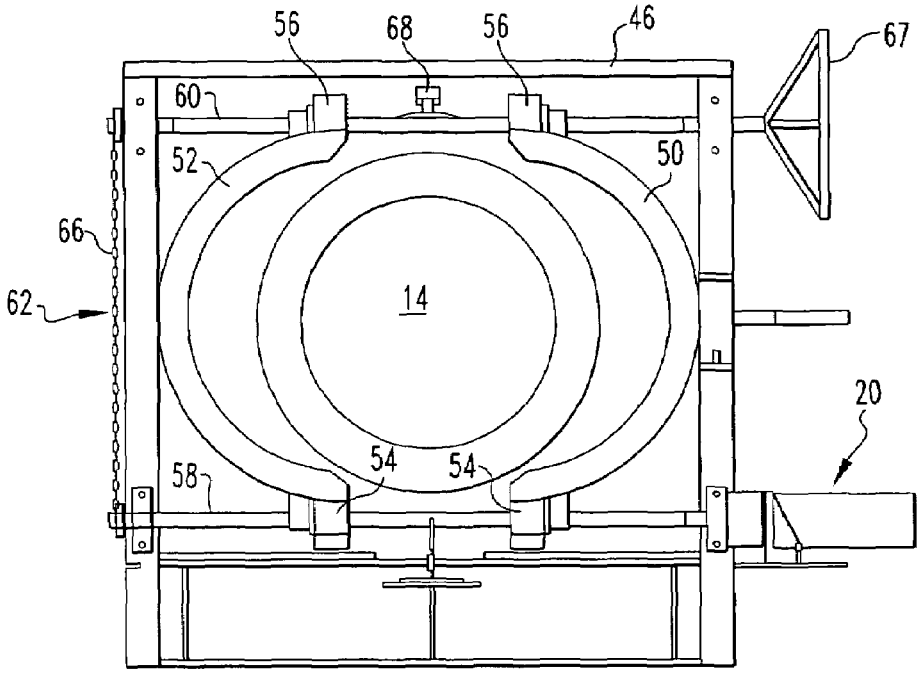
FIG. 2 is a front view illustration of the present invention.
Figure 3:
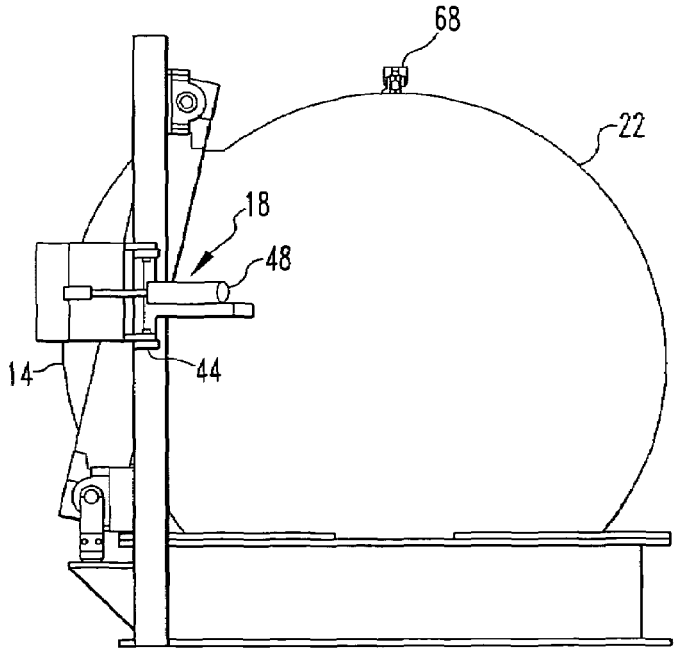
FIG. 3 is a side view illustration of the present invention.
Figure 4:
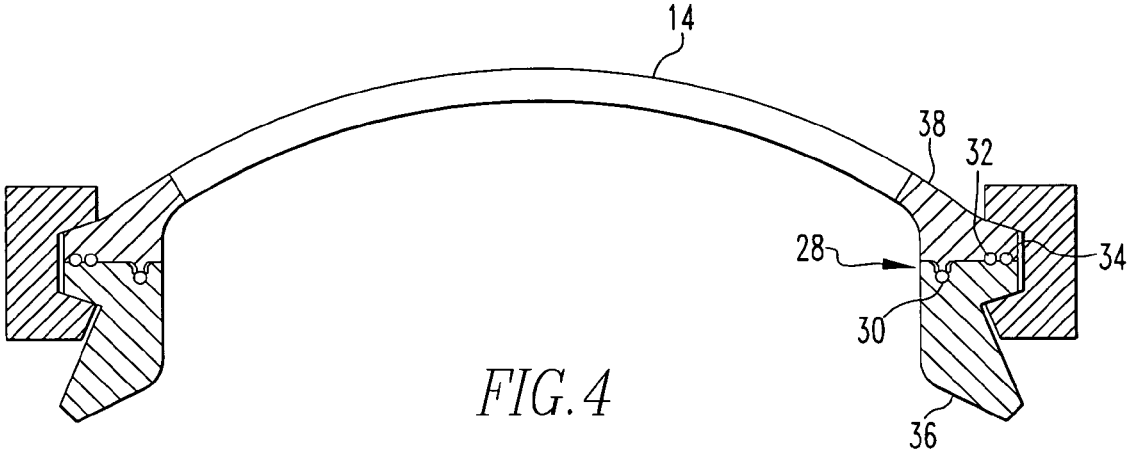
FIG. 4 is cross-sectional illustrations of a door of the present invention.
Figure 4A:
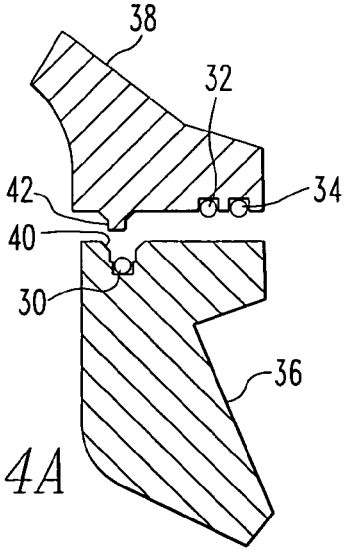
Figure 5:
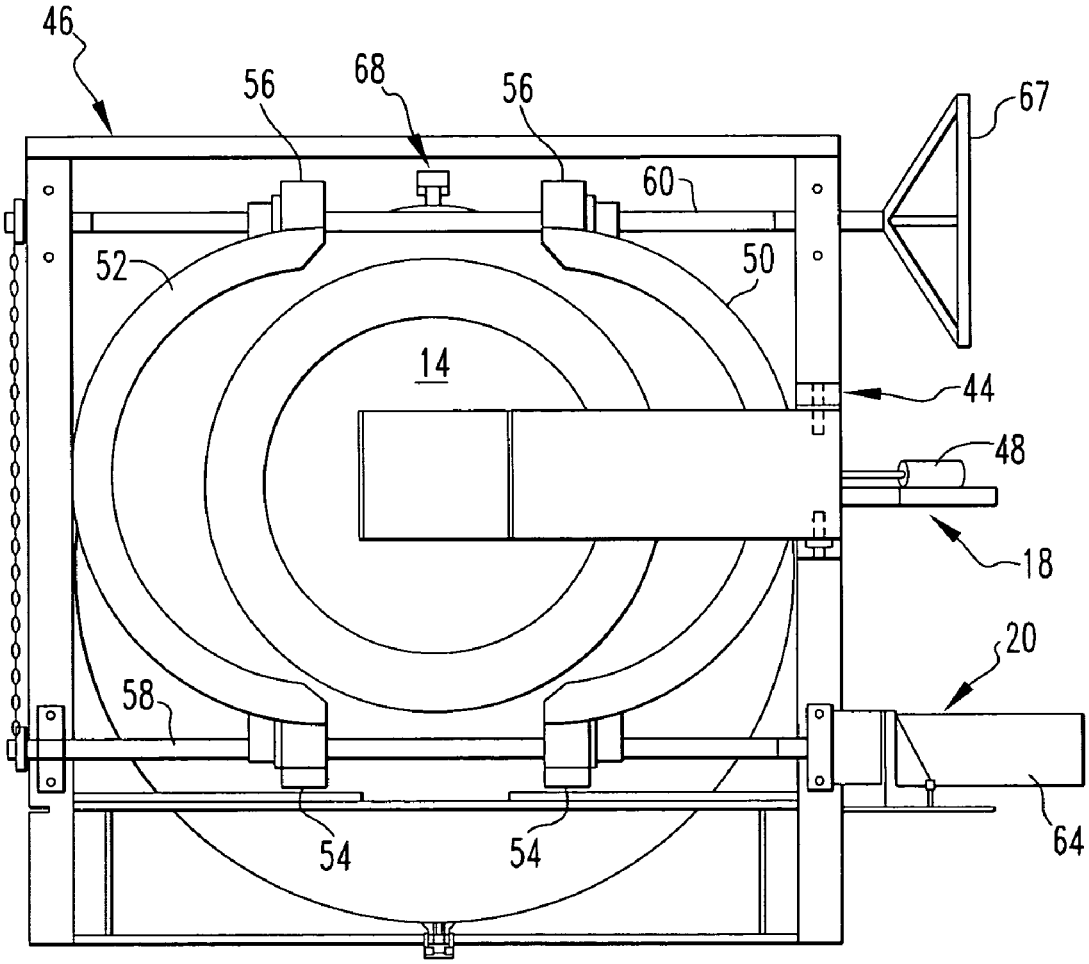
FIG. 5 is a front view illustration of a hydraulic door closing system of the present invention.

Referring to FIGS. 1-5, the present invention is a sealed upscale total containment vessel (UTCV) 10. The UTCV 10 includes a body 12, a door 14, a yoke 16, a first system 18 to open and close the door 14, and a second system 20 to open and close the yoke 16.

The body 12 is preferably a substantially spherical vessel 22. An opening 24 is located on the body 12. The opening 24 provides a passage to an interior 26 of the body 12 for the insertion and extraction of blast event materials.

The door 14 forms a seal 28 around the opening 24 when the door 14 is in a closed position. Inflatable seals of a conventional UTCV are replaced with at least one large o-ring. Preferably, three o-rings are used to maintain redundancy in the system.

A first o-ring 30 assists in the formation of the seal 28. The first o-ring 30 suppresses flames and hot gasses generated during a blast event. Preferably, a second o-ring 32 and a third o-ring 34 are provided between the door 14 and the body 12 to maintain redundancy in the sealing during the blast event. In this construction, the first o-ring 30 also protects the second and third o-rings 32,34.

Preferably, the body 12 includes an opening support ring 36 that defines (or surrounds) the opening 24. Similarly, the door 14 includes a door support ring 38. The opening support ring 36 includes a valley 40. Accordingly, the door support ring 38 has a ridge 42 that protrudes from a surface of the door support ring 38 and is configured to mate with (or be received by) the valley 40 in the opening support ring 36. The ridge 42 and mating valley 40 serve to mitigate the flame and hot gasses, as well as protect the second and third o-rings 32, 34 from the blast load. The first o-ring 30 is located in the valley 40 in the opening support ring 36.

Preferably, the door 14 and the opening 24 are substantially circular. Likewise, the door support ring 38 and the opening support ring 36 are circular. Accordingly, the ridge 42 and valley 40 are annular.

The door 14 is an external door. A hinge 44 mounted on a support frame 46 of the UTCV 10 supports the door 14. The first system 18 automatically opens and closes the door 14. The door 14 is moved from an open to a closed position by a hydraulic cylinder 48 that is mounted to the support frame 46. In the absence of hydraulic power, the door 14 can be closed by hand.

The yoke 16 retains the door 14 in the closed position. Preferably, the yoke 16 includes a first yoke member 50 and a second yoke member 52. Given a circular door 14, the yoke 16 is likewise circular with the first yoke member 50 and the second yoke member 52 each being substantially semicircular.

The first yoke member 50 and the second yoke member 52 are automatically moved into the closed position by the second system 20. Each of the first yoke member 50 and the second yoke member 52 include a first threaded end 54 and a second threaded end 56. A first threaded rod 58 engages the first threaded ends 54 of the first and second yoke members 50, 52. A second threaded rod 60 engages the second threaded ends 56 of the first and second yoke members 50, 52. A connecting apparatus 62 interconnects the first and second threaded rods 58, 60. A hydraulic motor 64 powers the rotation of the first and second threaded rods 58, 60. For example, the motor 64 turns the lower (first) threaded rod 58. The upper (second) threaded rod 60 is turned simultaneously by a chain drive system 66. Alternatively, the upper threaded rod 60 may be rotated by the motor 64. The first and second threaded rods 58, 60 can be closed by hand in the absence of power to the second system 20 by a hand wheel 67 located, for example, on the top threaded rod 58.

Figure 6:
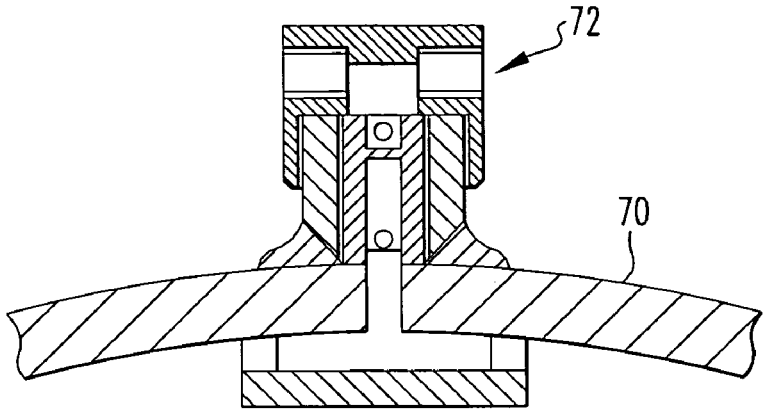
FIG. 6 is a cross-sectional front view illustration of a purge/drain port of the present invention.
Figure 7:
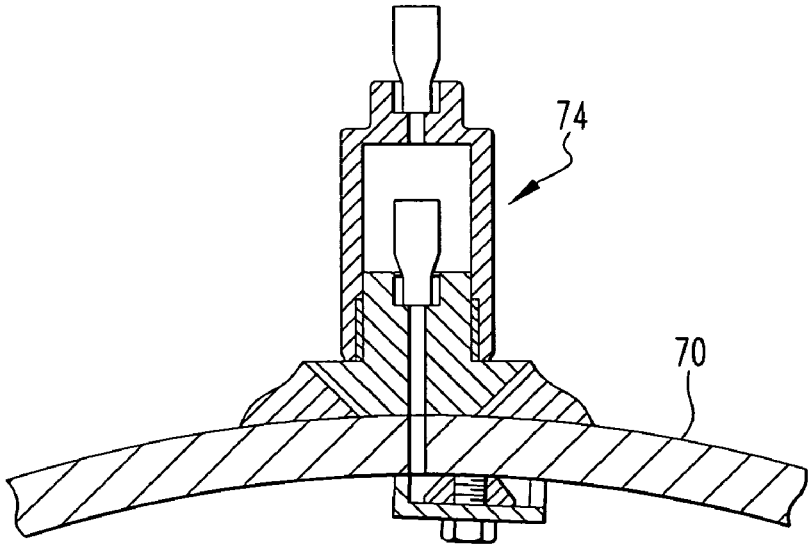
FIG. 7 is a cross-sectional front view illustration of a pass through port of the present invention.
Figure 8:
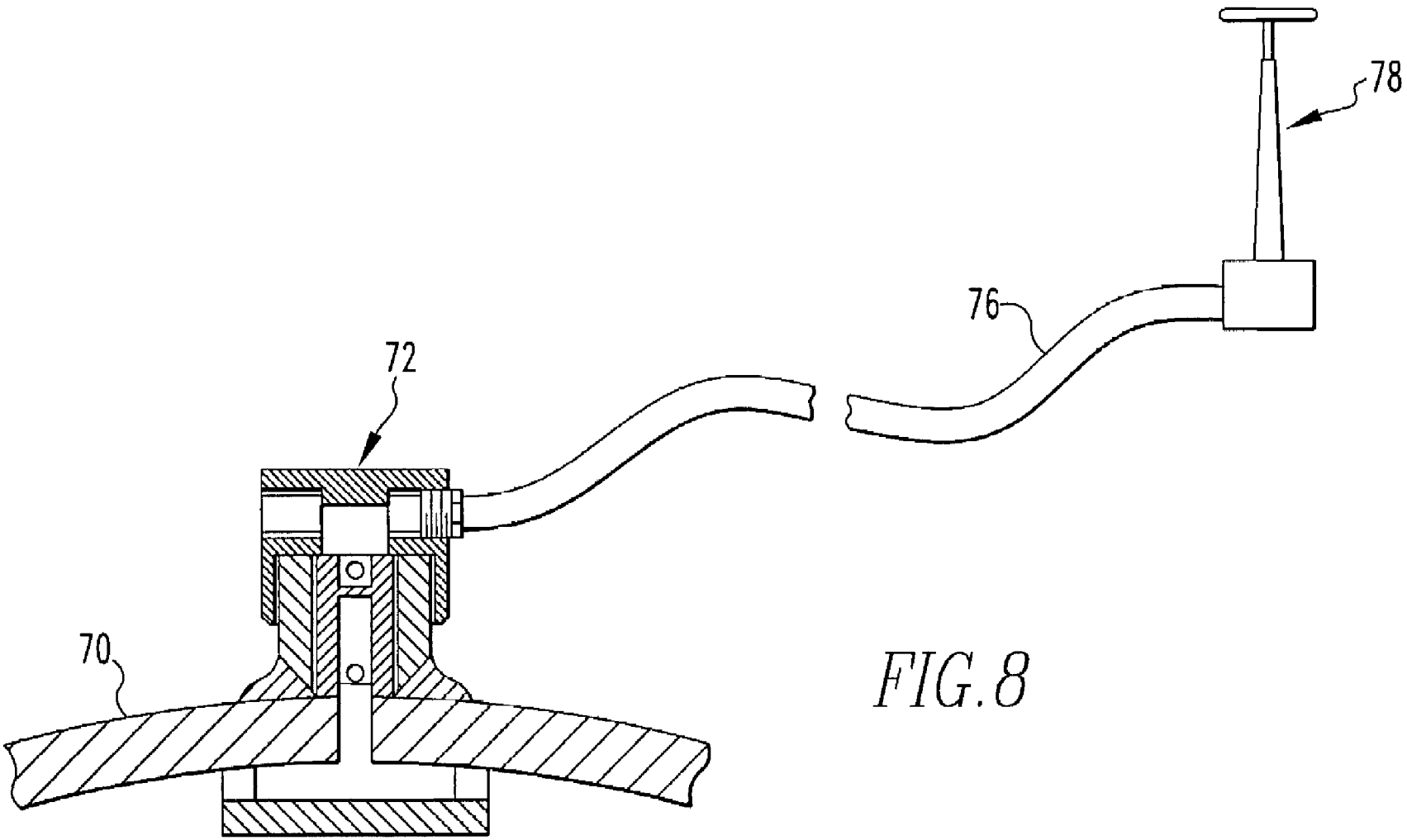
FIG. 8 is a cross-sectional front view illustration of the purge/drain port shown in FIG. 6 attached to a hose and valve.

Referring to FIGS. 5-8, the UTCV 10 also incorporates ports 68, for example, three ports, into a vessel wall 70 to allow the UTCV 10 to be sampled and decontaminated (purge/drain port 72) and to pass wires through the vessel wall 70 (pass through port 74) to energize a counter charge placed with the IED. These ports 68 are similar to the ports used in the prior art TCV. Both the purge/drain port 72 and the pass through port 74 remain sealed during the detonation and incorporate redundancy in the sealing mechanism. The pass through port 74 is designed to pass two wires through the vessel wall 70, while preventing all blast load and subsequent static pressure from escaping the UTCV 10. Redundancy is incorporated into the design by having two glands in series where the wires pass through, as well as two o-rings at all locations.

The purge/drain port 72 is designed to allow fluid and gas flow in and out of the UTCV 10, after the event occurs, through the attached hose 76 and valve 78. During the event, the internal mechanism of the purge/drain port 72 is designed to prevent the blast load generated during a detonation from escaping the UTCV 10 and impacting the attached hoses 76 and valves 78 located at the end of the hoses 76. While the purge/drain port 72 is designed to inhibit the blast pressure, it will allow static pressure through when the valves 78 are opened to facilitate decontamination.

The design charge weights for the present invention are:

3-lbs TNT—totally sealed system, repeatable detonations. The UTCV 10 will require decontamination and maintenance, but no repairs.

15-lbs TNT—repeatable detonations with venting. Minor repairs may be required which include mechanical components, ports 68, and flanges (at the yoke 16, door 14, and body 12).

26-lbs TNT—one-time event with venting. Major repairs may be required to all components of the system. However, the system will retain structural integrity during the event.

The door 14 contains the blast structurally and remains sealed throughout the event.

The UTCV 10 may be removably or permanently positioned on a trailer 80 for portability.

It will be understood by those skilled in the art that while the foregoing description sets forth in detail preferred embodiments of the present invention, modifications, additions, and changes might be made thereto without departing from the spirit and scope of the invention.

The invention claimed is:

1. A blast containment vessel, comprising:

a body having an opening;

an external door configured to form a seal surrounding the opening when the external door is in a closed position and wherein the external door includes a door support ring surrounding a perimeter of the external door and the body includes an outwardly extending ring surrounding the opening for supporting the door support ring;

a ridge located on the door support ring;

a valley located in the outwardly extending ring, said valley configured to receive the ridge;

an o-ring positioned in the valley to form a first seal between the body and the external door when the external door is in the closed position;

a yoke configured to retain the door in the closed position;

a first automatic system configured to automatically move the external door into and out of the closed position; and a second automatic system configured to automatically move the yoke when the external door is in the closed position, wherein during and after a blast event, the body and the external door contain products of the blast event and the seal remains intact.

2. The blast containment vessel according to claim 1, further including at least one o-ring positioned to seal a joint between the external door and the opening when the external door is in the closed position.

3. The blast containment vessel according to claim 2, further including three o-rings positioned to seal the joint between the external door and the opening when the external door is in the closed position.

4. The blast containment vessel according to claim 1, wherein:

the ridge is annular, and the valley is annular.

5. The blast containment vessel according to claim 1, further including a second o-ring positioned to form a second seal between the body and the external door when the external door is in the closed position.

6. The blast containment vessel according to claim 5, further including a third o-ring positioned to form a third seal between the body and the external door when the external door is in the closed position.

7. The blast containment vessel according to claim 1, further including a hinge fixedly attaching the external door to the body.

8. The blast containment vessel according to claim 1, wherein:

the first automatic system includes at least one hydraulic component, the second automatic system includes at least one hydraulic component.

9. The blast containment vessel according to claim 1, wherein the yoke includes a first yoke member and a second yoke member configured to mate with the first yoke member.

10. The blast containment vessel according to claim 9, wherein:

the external door is substantially circular, the yoke is substantially circular, the first yoke member is semicircular, and the second yoke member is semicircular.

11. The blast containment vessel according to claim 10, wherein:

the semicircular first yoke member includes a first threaded end and a second threaded end, the semicircular second yoke member includes a first threaded end and a second threaded end, and the second automatic system includes:

a first threaded rod configured to engage the first threaded ends of the first yoke member and the second yoke member;

a second threaded rod configured to engage the second threaded ends of the first yoke member and the second yoke member;

a rotation apparatus to rotate one of the first threaded rod and the second threaded rod; and a connecting apparatus for interconnecting the first threaded rod and the second threaded rod, where rotation of the one of the first threaded rod and the second threaded rod causes rotation of the other of the first threaded rod and the second threaded rod.

12. The blast containment vessel according to claim 1, further including:

a first manual system configured to manually move the external door into and out of the closed position; and a second manual system configured to manually move the yoke when the external door is in the closed position.

13. The blast containment vessel according to claim 1 wherein the vessel is adapted for containing a blast of up to and including 26 lbs. of TNT.

14. A blast containment vessel, comprising:

a body having an opening;

a door configured to form a seal surrounding the opening when the door is in a closed position;

a series of o-rings positioned to seal a joint between the external door and the opening when the external door is in the closed position and wherein the external door includes a door support ring surrounding a perimeter of the external door and the body includes an outwardly extending ring surrounding the opening for supporting the door support ring;

a ridge located on the door support ring;

a valley located in the outwardly extending ring, said valley configured to receive the ridge and wherein at least one of said o-rings is positioned in the valley to form a first seal between the body and the external door when the external door is in the closed position;

a yoke configured to retain the door in the closed position;

a first system configured to move the external door into and out of the closed position; and a second system configured to move the yoke when the external door is in the closed position, wherein during and after a blast event, the body and the door contain products of the blast event and the seal remains intact.

* * * * *